United States Patent [19]

Hamilton

[11] 4,301,604

[45] Nov. 24, 1981

[54] BOWLING OVERSHOE

[76] Inventor: Herbert M. Hamilton, 7422 Eddy St., Riverside, Calif. 92509

[21] Appl. No.: 57,205

[22] Filed: Jul. 13, 1979

[51] Int. Cl.[3] ..... A43B 5/00

[52] U.S. Cl. ..... 36/130; 36/135

[58] Field of Search ..... 36/7.1, 7.3, 72 R, 135, 36/130, 101

[56] References Cited

U.S. PATENT DOCUMENTS

| | | | |
|---|---|---|---|
| 1,836,624 | 12/1931 | Sothen | 36/113 |
| 3,040,451 | 6/1962 | Hilkemeyer | 36/130 |
| 3,099,884 | 8/1963 | Kixmiller et al. | 36/101 |
| 3,808,712 | 5/1974 | Elliott | 36/7.3 |
| 3,858,336 | 1/1975 | Brown | 36/7.3 |

*Primary Examiner*—Patrick D. Lawson

*Attorney, Agent, or Firm*—G. Donald Weber, Jr.

[57] ABSTRACT

There is shown and described an extremely simple, inexpensive, easily useable apparatus for covering footwear, such as bowling shoes, to avoid an undesirable contamination of the soles thereof.

6 Claims, 3 Drawing Figures

BOWLING OVERSHOE

BACKGROUND OF THE INVENTION

1. Field of the Invention.

This invention is directed to protective footwear, in general, and to protective devices for bowling shoes, in particular.

2. Prior Art.

There are many examples of specialized footwear which are useful in specialized activities. Notably, such specialized types of footwear are used when the wearer is involved in sports or athletic activities, for example golf shoes, jogging shoes, and, of course, bowling shoes. In most cases, the shoes or footwear include specialized soles thereof which assist the athlete in the activity in which he is involved. For example, golf shoes include cleats which assist in gripping the ground during a swing. Bowling shoes include specialized soles for permitting the user to slide readily during delivery of the bowling ball. Other examples are well known.

One of the most troublesome aspects of bowling is the fact that occasionally the sliding sole of the bowling shoe becomes contaminated with foreign matter and causes the bowler to "stick" and, thereby, lose control of his bowling form. This can result in a poorly delivered ball or even result in the bowler falling and thereby risking injury.

The contamination is usually encountered when the bowler engages in some non-bowling activity such as visiting the restroom, the restaurant area or the like. In addition, bowlers and spectators all too frequently bring condiments of some nature into the bowling area and spill or drop some of this material onto the floor where it is stepped on by the bowler wherein the sole of the shoe is contaminated.

To avoid this, bowlers are typically confined to the specific bowling area. On the other hand, in order to visit the restroom, for example, a bowler must remove at least the sliding bowling shoe and put on the counterpart street shoe. After attending to the non-bowling business, the bowler must now reverse the procedure, i.e. removing the street shoe and returning to the bowling shoe. All of this is annoying to the individual and, perhaps more importantly, to the other members of the group. In addition, this type of activity, (either the shoe changeover or the cleanup required after contamination) causes the game to be delayed. This delay is, of course, annoying and undesirable to the players in general and, in the instance of league play, can be disconcerting to the entire league and the following players as well. Consequently, it is highly desirable to provide a means to readily and easily permit the bowler to cover and/or protect the sliding bowling shoe to prevent contamination and to avoid unnecessary delays.

PRIOR ART STATEMENT

The most pertinent prior art which has been discovered by applicant in the course of a preliminary search is listed herewith.

U.S. Pat. No. 3,040,451, Hilkemeyer, shows a flat piece of material having projections around the perforated area thereof. Each of the projections include slots for receiving an elastic band which causes the material to snugly fit the shoe.

U.S. Pat. No. 3,012,343, Dinkel, shows a tubular arrangement for receiving and protecting the toe and sole portion of the shoe but not the heel portion.

U.S. Pat. No. 2,207,091, Fetterby et al, shows a heavy duty sole protector which is not pertinent to this application.

U.S. Pat. No. 2,032,052, Friedenberg, shows a rigid shoe protector for use with cleated shoes such as golf shoes.

U.S. Pat. No. 3,834,377, Lebold, shows an orthopedic shoe platform with Velcro fasteners.

SUMMARY OF THE INVENTION

The instant invention is directed to a simple, inexpensive, readily useable bowling shoe protector. The invention comprises a blank which is cut in the general configuration of oval or foot-shaped configuration. The blank is cut from a thin elastic material which is generally of a slightly smaller size than the bowling shoe to be protected. Suitable fasteners are affixed to the ends of the protector blank. Suitable counterpart fasteners can be applied to an ordinary bowling shoe, if desirable, and dependent upon the type of fastener used with the protector blank.

DESCRIPTION OF THE PREFERRED EMBODIMENT

Figure 1:
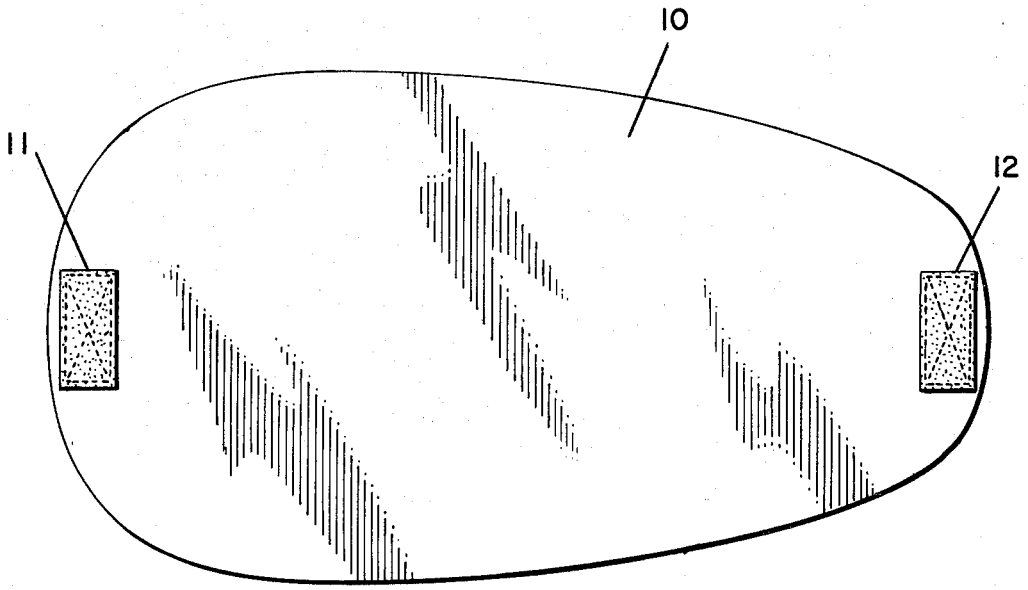
FIG. 1 is a plan view of the protector blank of the instant invention.
Figure 2:
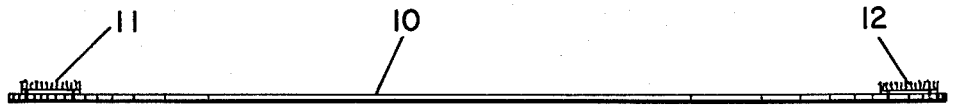
FIG. 2 is a side view of the protector blank of the instant invention.

Referring concurrently to FIGS. 1 and 2, it is seen that the bowling shoe protector comprises a basic blank which is of substantially oval or foot-shaped configuration. Affixed to the "heel" end of blank 10 is fastener 12 which can be formed of one-half of a Velcro fastener, a snap fastener or any other suitable device.

Likewise, at the "toe" end of blank 10 is disposed a second fastener 11. Fastener 11 may also be a Velcro fastener, a snap fastener of the like. In the embodiments shown, fasteners 11 and 12 are depicted as Velcro type fasteners, but other fasteners are contemplated. While not specifically shown, it is possible that fasteners 11 and 12 can be provided by means of forming a lip or the like at the heel and toe portions for engaging the heel and toe of the bowling shoe.

Blank 10 is typically formed of an elastic material which is also resilient and, therefore, tends to be stretchable but have a return "memory". Typical materials for blank 10 are a thin latex rubber such as the type used in fabricating rubber gloves or the like. Other suitable types of material can be utilized and the noted example is illustrative only.

Figure 3:
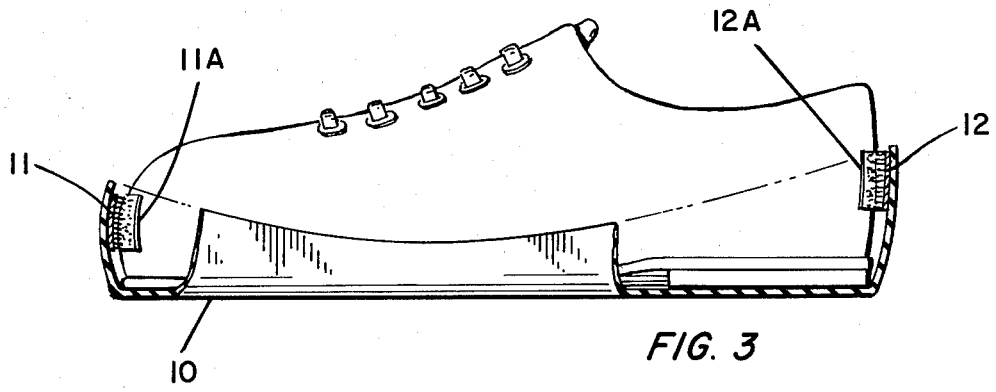
FIG. 3 is a side view which is partially cut-away to show the protector in use and operating with an ordinary bowling shoe.

Referring now to FIG. 3, there is shown a view of the protective overshoe in use with an ordinary bowling shoe. In this illustration, counterpart fastener means have been applied to the bowling shoe. For example, fastener 11A has been provided at the toe end of the shoe while fastener 12A has been provided at the heel end of the shoe. Fasteners 11A and 12A are, in this illustration, depicted as Velcro type fasteners or the like. In addition, the fasteners appear relatively large (as compared to fasteners 11 and 12) in this illustrative view.

In operation, the bowler takes the protective shoe and typically joins fastener 11 to fastener 11A on the bowling shoe. Protective overshoe 10 is then stretched beneath the bowling shoe and fastener 12 is joined to fastener 12A. (Of course, the procedure can be performed in the reverse order.) Thus, the protective blank 10 is disposed beneath the sole of the bowling shoe to provide the appropriate protection. The fastener arrangements maintain the protective overshoe in the desired position. In addition, because blank 10 has been stretched, the extra width of the protective blank tends to, automatically, rise up above the sole of the bowling shoe to, thus, protect the outer edges thereof as well.

Thus, there has been shown and described a protective overshoe blank for the use with bowling shoes, in particular. There has been described a preferred configuration of the overshoe. However, it must be understood that other configurations can be provided without departing from the basic concept described herein. Also, the drawings represent the bowling overshoe wherein the thickness is, or may be, somewhat exaggerated. The length, width and thickness are somewhat dependent upon the type of material used to produce the protective overshoe blank. Moreover, the material is described as a resilient, elastic material. A thin rubber material has been suggested but other suitable materials of appropriate characteristics are contemplated as well. The descriptive details are intended to be illustrative only and are not intended to be limitative of the invention. Rather, the invention is limited only by the claims appended hereto.

Having thus described a preferred embodiment of the invention, what is claimed is:

1. A protective overshoe arrangement comprising,
a flat, generally oval blank of a resilient, elastic material,
first fastening means disposed at one end of said blank and adapted to engage a counterpart fastening means on a shoe, and
second fastening means disposed at the other end of said blank and adapted to engage a counterpart fastening means on a shoe.

2. The arrangement cited in claim 1, wherein,
said first and second fastening means comprise Velcro fasteners.

3. The arrangement recited in claim 2 including,
a bowling shoe having counterpart fasteners at the heel and toe portions thereof.

4. The arrangement recited in claim 1 wherein,
said blank is formed of a thin rubber material.

5. The arrangement recited in claim 1 wherein,
said generally oval blank is wider adjacent said one end thereof than said other end.

6. The arrangement recited in claim 3 wherein,
said blank is normally shorter than said bowling shoe until stretched to cover the sole of said bowling shoe.

* * * * *